US005784813A

United States Patent [19]

Balassa et al.

[11] Patent Number: 5,784,813

[45] Date of Patent: Jul. 28, 1998

[54] SPOOL AND WEDGE ASSEMBLY

[75] Inventors: Oscar Balassa, Queensland; Bruce Wells, Kings Langley, both of Australia

[73] Assignee: Cutting Edges Pty. Limited, New South Wales, Australia

[21] Appl. No.: 712,260

[22] Filed: Sep. 11, 1996

[30] Foreign Application Priority Data

Sep. 13, 1995 [AU] Australia ..... PN5406

[51] Int. Cl.[6] ..... E02F 9/28; E02F 3/14

[52] U.S. Cl. ..... 37/455; 37/457

[58] Field of Search ..... 37/451, 450, 452, 37/453, 454, 455, 456, 457, 458, 446; 403/374, 373, 21, 22

[56] References Cited

U.S. PATENT DOCUMENTS

| | | | |
|---|---|---|---|
| 2,020,215 | 11/1935 | Ross | 37/454 X |
| 2,385,395 | 9/1945 | Baer | 37/458 |
| 3,453,756 | 7/1969 | Schroeder | 37/454 |
| 4,433,496 | 2/1984 | Jones et al. | 37/456 |
| 5,452,529 | 9/1995 | Neuenfeldt et al. | 37/455 |
| 5,562,206 | 10/1996 | Ruvang | 37/455 X |

FOREIGN PATENT DOCUMENTS

| | | |
|---|---|---|
| PCT/AU94/00035 | 12/1995 | WIPO . |

*Primary Examiner*—Michael J. Carone
*Assistant Examiner*—Robert Pezzuto
*Attorney, Agent, or Firm*—David P. Gordon; David S. Jacobson; Thomas A. Gallagher

[57] ABSTRACT

A spool and wedge assembly for attaching a replaceable implement to the nose of an earthworking bucket has a spool 12 and wedge 10 with ramp surfaces 22, 40 causing lateral expansion of the unit upon relative axial movement, and bolting mechanism 14, 16 for drawing the spool and wedge together so that the wedge pushes forwardly against the bucket nose and the spool pushes forward against the implement. A disengagement tool 78 acts between the wedge and the bolt 14 to force disengagement of the ramp surfaces for removal.

18 Claims, 8 Drawing Sheets

SPOOL AND WEDGE ASSEMBLY

BACKGROUND OF THE INVENTION

1. Field of the Invention

The present invention relates to connection pin assemblies for attaching replaceable implements to earthworking buckets of excavating equipment and the like. The invention also relates to a method of attachment, and to earthworking buckets with replaceable implements attached by means of the connection pin assemblies.

2. State of the Art

Earth working bucket used for heavy earthworks applications such as mining are fitted with teeth for engaging the ground surface. Due to the highly abrasive nature of the materials encountered by the teeth, they wear more quickly than the bucket. For this reason, they are detachably connected to the bucket to allow replacement.

On smaller buckets, the teeth are generally attached directly to an adapt or on the bucket by means of a connection pin. On larger buckets, intermediate adaptors are attached to the bucket nose and the teeth are attached to respective of the intermediate adaptors. Both connections are by means of connection pins, so that the teeth and intermediate adaptors can be replaced as required.

Connection pin assemblies of the type generally employed, and with which this invention is concerned, are known in the art as spool and wedge assemblies.

Prior art spool and sedge assemblies include a spool, often C-shaped with tapered engagement surfaces, which can be inserted into aligned apertures in the parts to be connected. A wedge is then inserted to contact the rear surface of the C and is driven home by sledgehammer to cause lateral expansion of the spool and wedge until it bears firmly against appropriate parts of the inner wills of the apertures to provide lateral loading and optionally a clamping action of the adaptor in the case of 'Whisler' style attachments. Any part of the spool and wedge protruding above or below the aligned apertures is then cut off by oxy acetylene equipment.

The tightness of the connections must be regularly monitored, and when a tooth or intermediate adaptor works loose the spool and wedge must be tightened by hammering the wedge in further. This can be difficult as the protruding part of the wedge may already have been removed and thus the end of the wedge is not readily accessible. When the tooth or intermediate adaptor requires replacement, the spool and wedge often has to be cut out.

It will be appreciated that the fitting, monitoring, adjustment and removal of the prior art spool and wedge assemblies is time consuming and labour intensive, particularly as each bucket will have a number of teeth and an equal number of adaptors, each attached by respective spool and wedge assemblies.

Patent Application No. PCT/AU94/00035 describes a spool and wedge assembly in which a pair of spools are forced apart by a pair of wedges which are drawn together by a bolt. While that disclosure is in some respects an improvement over the prior art, there is much scope for improvement. For example, the arrangement is relatively complicated, still requires regular monitoring and adjustment and, in practice, may need to be cut out for removal.

SUMMARY OF THE INVENTION

The present invention aims to provide alternative spool and wedge assemblies.

In a first form, the invention provides a spool and wedge assembly for attaching a replaceable implement to the nose of an earthworking bucket, the spool and wedge assembly including;

at least one spool having a first surface, at least one wedge having a second surface, the first and second surfaces co-operating to form a ramp arrangement which causes lateral expansion of the spool and wedge assembly upon relative axial movement in a first direction in which said surfaces are drawn towards each others, bolting means for forcing said relative movement in said first direction, and disengagement means adapted to act between said spool and/or wedge and the bolting means to cause relative movement of the spool and wedge in a second direction opposite the first direction.

Preferably, the disengagement means engages with the spool or wedge and, desirably, includes screw means bearing against the bolting means to force relative movement of the spool or wedge and the bolting means.

In a further form, the invention provides a spool and wedge assembly for attaching a replaceable implement to the nose of an earthworking bucket, the spool and wedge assembly including:

at least one spool having a first surface, at least one wedge having a second surface, the first and second surfaces co-operating to form a ramp arrangement which causes lateral expansion of the spool and wedge assembly upon relative axial movement in a first direction in which said surfaces are drawn towards each other, bolting means for causing said relative movement in said first direction, and resilient means which deforms under load from said bolting means, so that when the bolting means is actuated to cause said lateral expansion the resilient means applies a resilient force urging the relative movement of the spool and wedge in said first direction.

Preferably, the resilient means comprises a resilient washer means, such as a spring washer arrangement or similar device, acting between the bolting means and the wedge.

As used herein, the expression "nose of an earthworking bucket" is to be understood as also including any intermediate adaptor fitted on the nose.

In a further form, the assembly is adapted to be inserted within aligned apertures in the replaceable implement and the bucket nose and contains a spool and a wedge with co-operating ramp surfaces as hereinbefore described, the bolting means forcing said relative movement rich that the lateral expansion causes the wedge to push forwardly against the nose and spool to push rearwardly against the implement.

Preferably, the bolting means includes a bolt with its bolt head captured by a slot in the spool, the bolt extending gene ally axially to enter an axial passage through the wedge.

Further preferred embodiments of the invention will now be described with reference to the accompanying drawings.

DETAILED DESCRIPTION OF THE PREFERRED EMBODIMENTS

Figure 1:
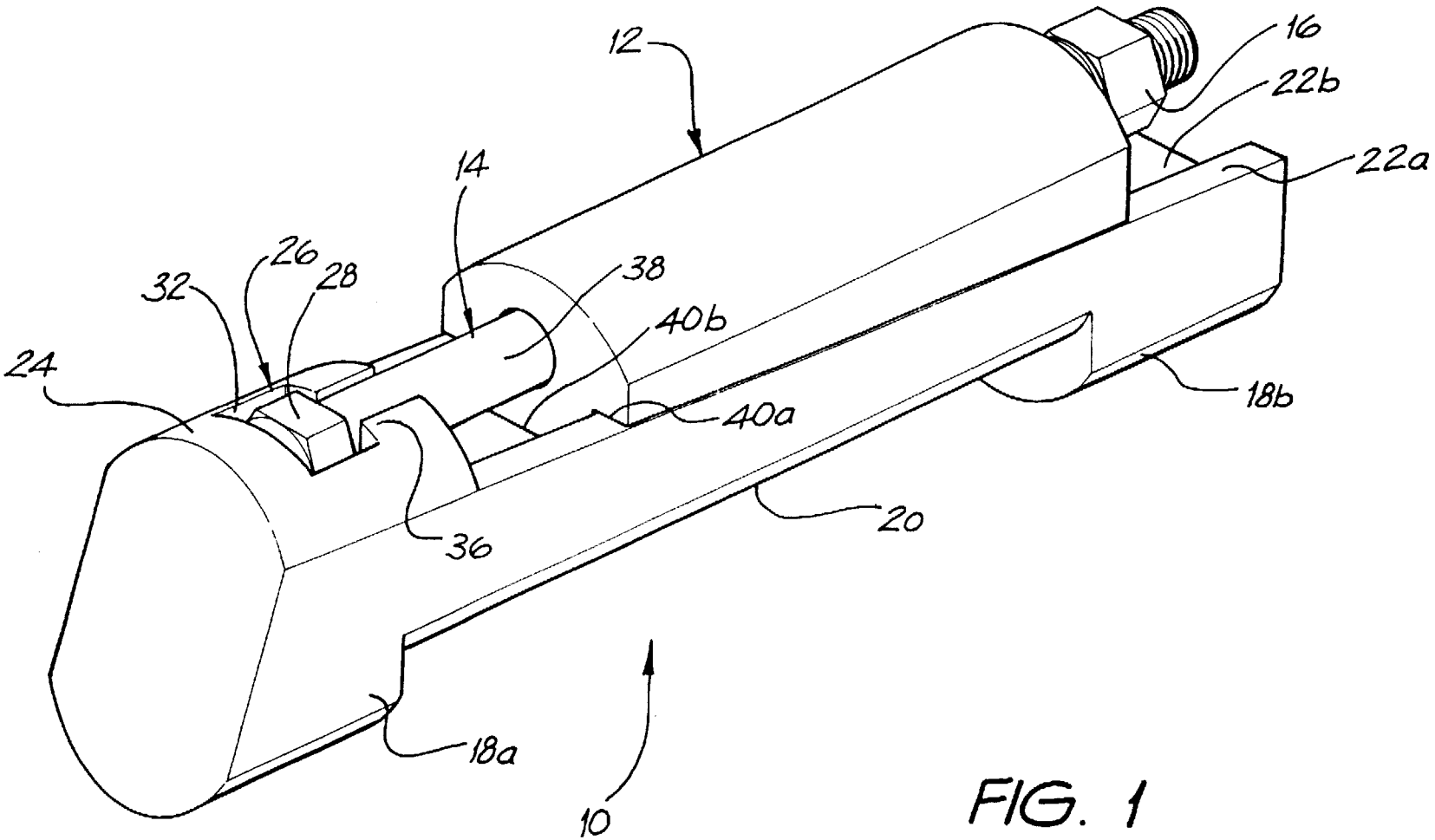
FIG. 1 is a perspective view of a preferred spool and wedge assembly.
Figure 2:
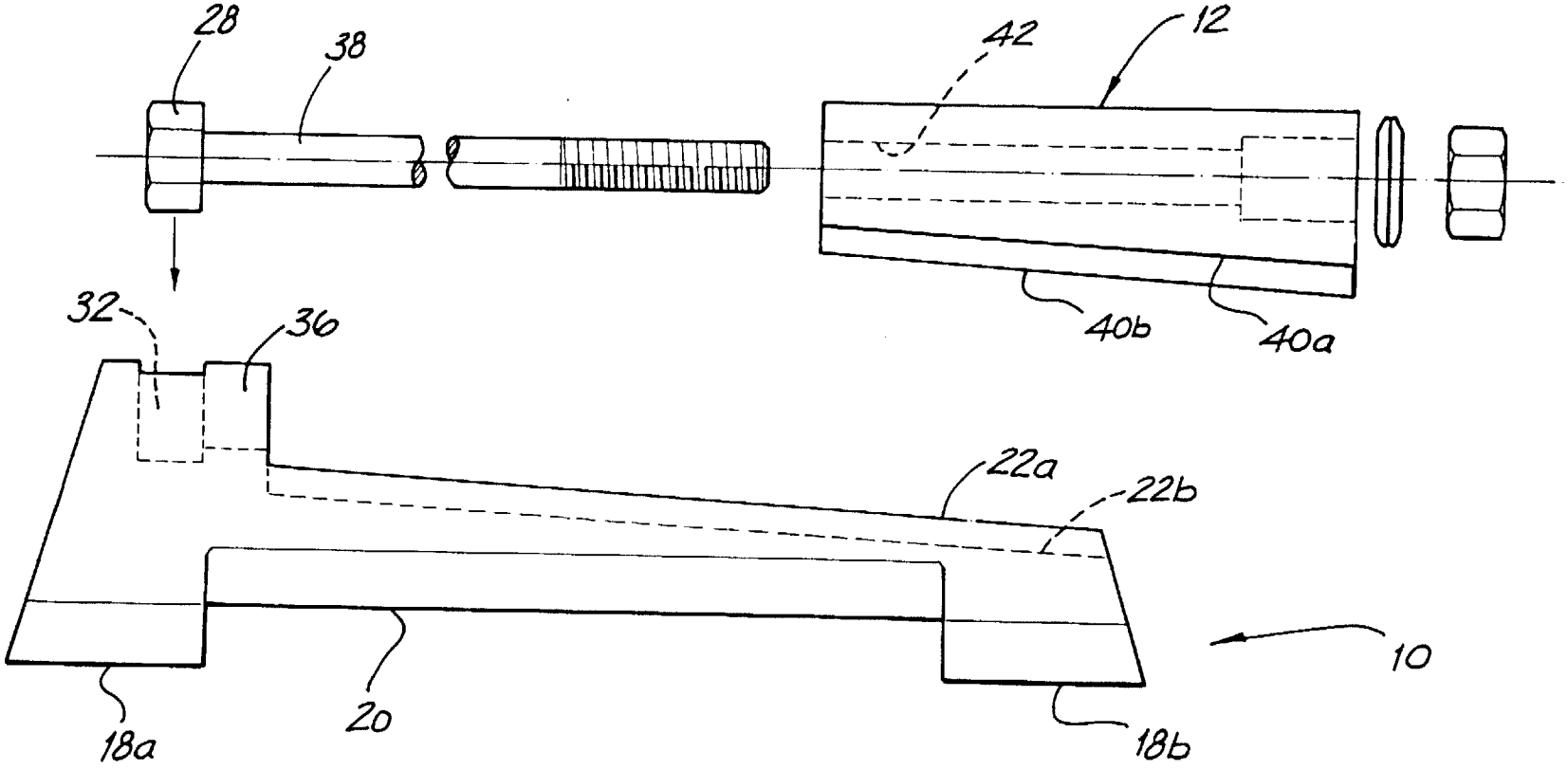
FIG. 2 is an exploded side elevation of the spool and wedge assembly of FIG. 1.
Figure 3:
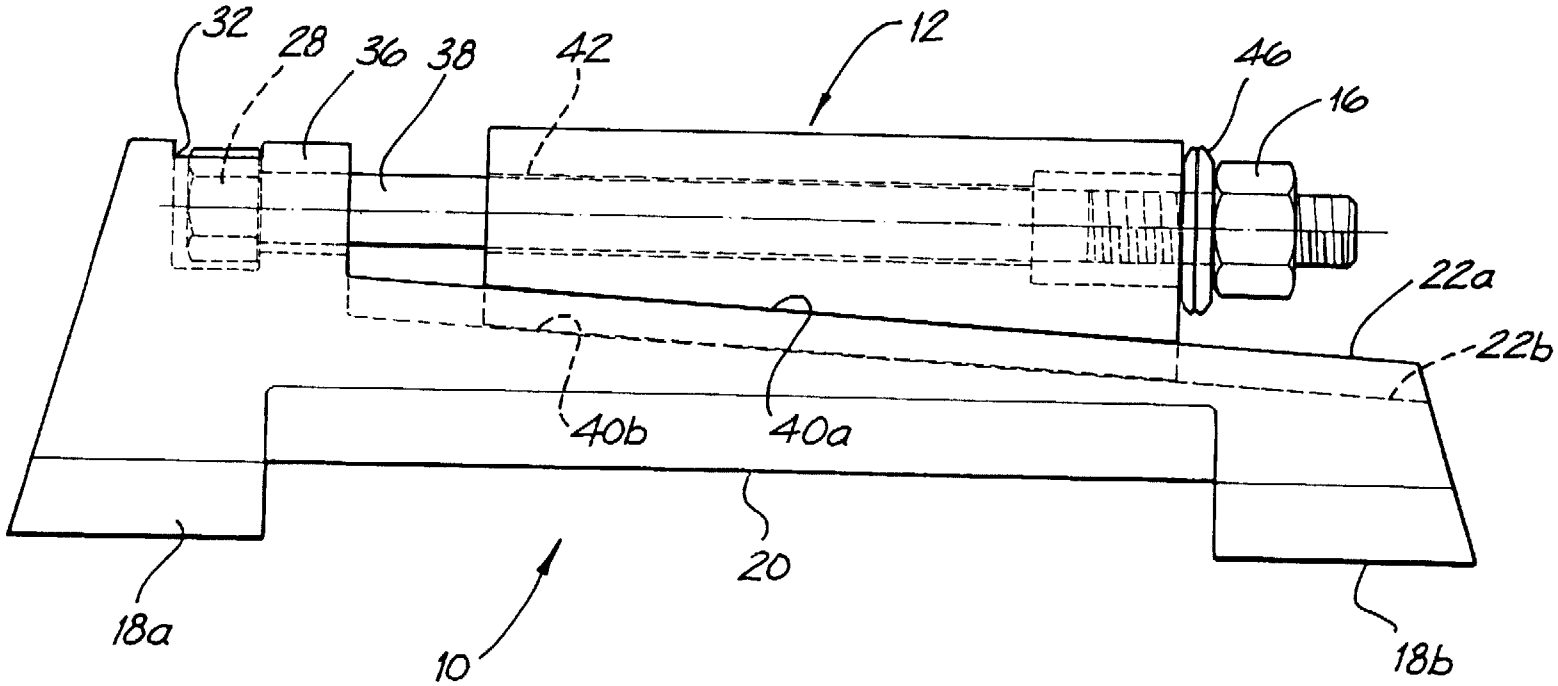
FIG. 3 is the same view as FIG. 2, after the wedge has been connected to the spool.

With reference to FIGS. 1–3, the spool and wedge assembly consists generally of a spool 10, a wedge 12, and a bolt 14 and nut 16 arrangement.

The spool 10 is elongated in the axial direction and is shaped to allow insertion in aligned apertures in the intermediate adaptor and the nose of a ground engaging implement, so as to engage with the back portion of the intermediate adaptor without engaging the back of the nose aperture. The illustrated spool has on one side thereof a pair of projections 18*a*, 18*b* separated by a recessed portion 20, so that that side of the spool 10 is approximately C-shaped.

The other side of the spool has ramp surfaces 22*a*, 22*b* and a block 24 for retaining the head of the bolt 14. The block 24 has an open slot 26 shaped to receive the head 28 of the bolt 14 which connects the wedge 12 to the spool 10.

The slot opens to the side of the spool opposite the projection 18*a*. The slot has a broader portion 32 for receiving the bolt bead and preventing its rotation, and a more narrow portion between shoulders 36 of the block to receive the part of the bolt shaft 38 adjacent the head. As can be seen from FIGS. 2 and 3, the bolt head is inserted into the slot so that the head is captured behind the shoulders 36. There is sufficient clearance behind the bolt head to allow the angular or lateral movement of the bolt to accommodate lateral expansion of the assembly as it is tightened.

The wedge 12 has ramp surfaces 40*a*, 40*b* complementary to the ramp surfaces 22*a* and 22*b* of the spool. The wedge also has an axial through-hole 42 through which the shaft of the bolt passes. The distal end of the bolt shaft has a threaded portion for attachment of the nut 16. A belleville spring washer 46 separates the nut 16 and the end of the wedge.

As the nut 16 is threaded onto the bolt shaft, the wedge is moved axially relative to the spool and the ramp surfaces 40*a*,40*b* of the wedge slide along those of the spool. This causes the spool and wedge assembly to expand laterally until it tightens against the inner walls of the apertures in which it has been inserted. Further tightening of the nut causes resilient compression of the spring washer 46.

By undergoing resilient compression, the spring washer provides self tightening of the spool and wedge assembly. If, in use, the nose to intermediate adaptor assembly works slightly loose, the spring washer will decompress, forcing the wedge further towards the bolt heed and therefore causing further lateral expansion o the assembly until the spool and wedge is again tight against the inner walls of the aligned apertures.

Figure 4A:
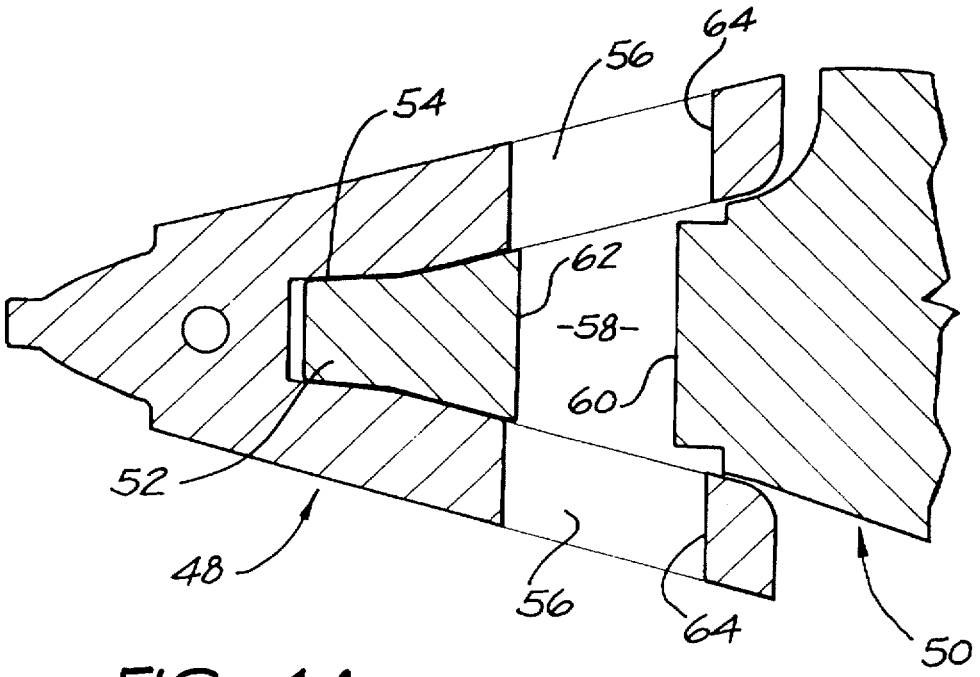
FIG. 4A is a cross-sectional elevation of an intermediate adaptor positioned on a bucket nose.

FIG. 4A illustrates the positioning of an excavator intermediate adaptor 48 on the nose 50.

The bucket nose has a tapering front portion 52 which is received in a corresponding tapered cavity 54 of the intermediate adaptor. When positioned properly on the bucket nose, an aperture 56 of the intermediate adaptor aligns with an aperture 58 of the bucket nose to allow insertion of the spool and wedge assembly shown in FIGS. 1–3.

Figure 4B:
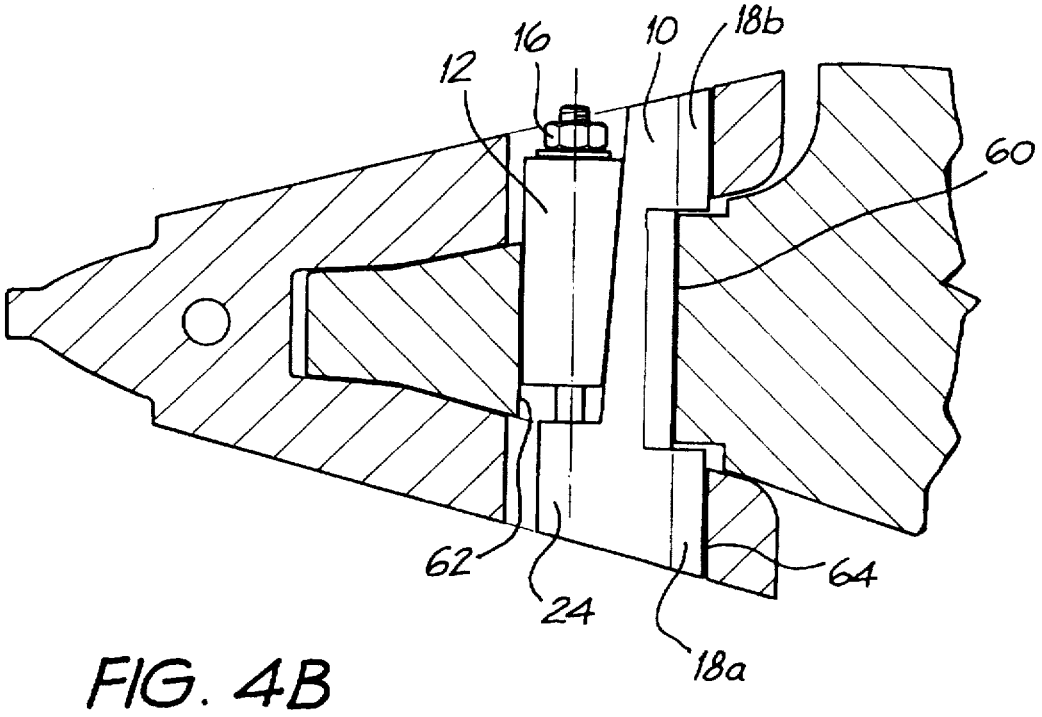
FIG. 4B shows the arrangement of FIG. 4A, with the spool and wedge inserted and tightened.

FIG. 4B shows the spool and wedge assembly inserted in the aligned apertures. The spool is dimensioned to pass between the rear 60 and front 62 walls of the aperture in the bucket nose and then be positioned so that the projection 18*a*, 18*b*, come into contact with the rear walls 64 of the aperture in the intermediate adaptor without contact between the recessed portion 20 and the rear wall 60 of the aperture.

The bolt is connected to the spool before insertion of the spool in the apertures, by capturing the bolt head in the block 24 of the spool as described above with reference to FIGS. 1–3. The wedge 12 and resilient device 46 are slid along the bolt shaft, and the nut is then threaded on to the bolt shaft to cause lateral expansion of the spool and wedge so that the wedge bears against the front wall 62 of the bucket nose 58 and the spool pushes against the rear walls 64 of the aperture in the intermediate adaptor 48. This forces the intermediate adaptor rearwards relative to the nose, tightening the engagement of the tapered surfaces 52 and 54 and thereby securing the intermediate adaptor to the bucket nose.

In a modification to the arrangement shown in FIGS. 1–4B, the nut 16 may be elongated and/or capped to cover the end threads of the bolt shaft. This ensures that the end threads of the bolt remain clean so that the nut can be removed.

In further modifications, the nut may be replaced with a hydraulic nut which is initially threaded onto the bolt. Final tightening is then effected by pumping grease or other fluid into the nut to cause it to expand. Alternatively, the bolt can have a round head which allows it to rotate in the slot 26 and has a drive block at its distal end. The wedge is threaded directly onto the bolt, so that rotation of the bolt via the drive block will cause tightening and disengagement of the spool and wedge.

Figure 5:
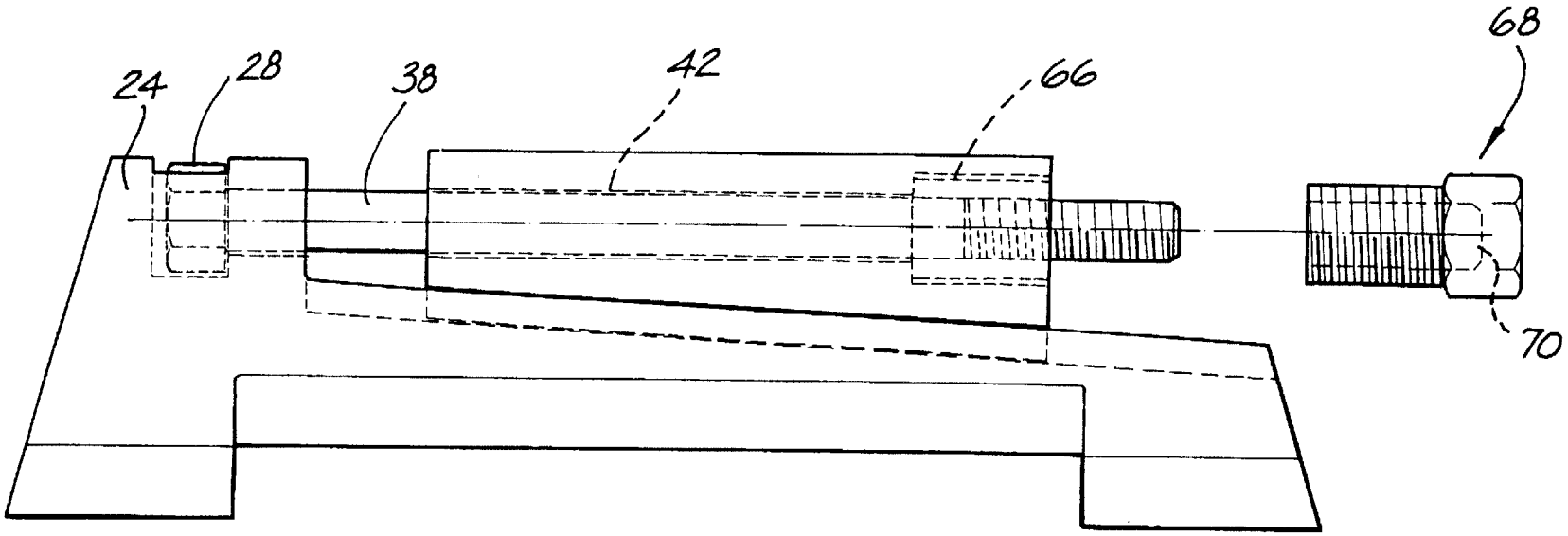
FIG. 5 is a side elevation of the spool and wedge assembly, in which the nut and washer are removed and replaced by a disengagement device.
Figure 6:
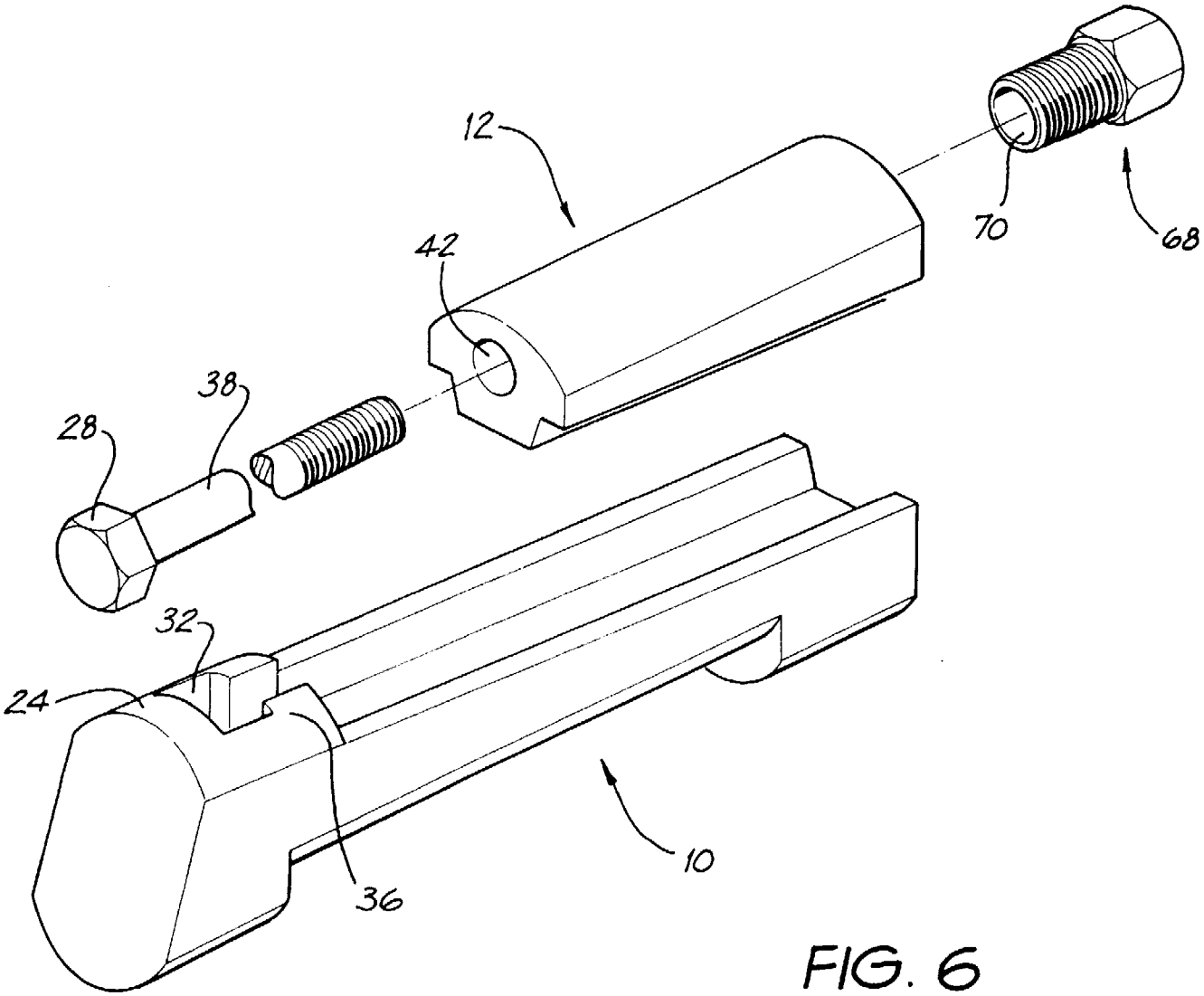
FIG. 6 is an exploded perspective view of FIG. 5.

FIGS. 5 and 6 illustrate a first arrangement for disengaging the ramp surfaces of the spool and wedge so that the assembly can be removed. The hole 42 through the wedge is broadened at its distal end, and this portion 66 of greater diameter is provided with an internal thread. There is provided a disengagement device 68 formed generally as a short bolt with a hollowed-out shaft. The external thread of this device mates with the internal thread of hole 66 so that the device screws into the end of the wedge.

The distal end of the bolt shaft 38 is received with clearance in the axial bore 70 in the shaft until the end of the bolt contacts the end of the bore. Screwing the device 68 into the wedge pushes the bolt backwards until the bolt head 28 contacts the end of slot 26. Further screwing of device 68 then drives the spool and wedge in opposite directions, so that the spool and wedge assembly is released from its tight engagement in the aligned apertures of the adaptor and tooth and can be removed.

Figure 7:
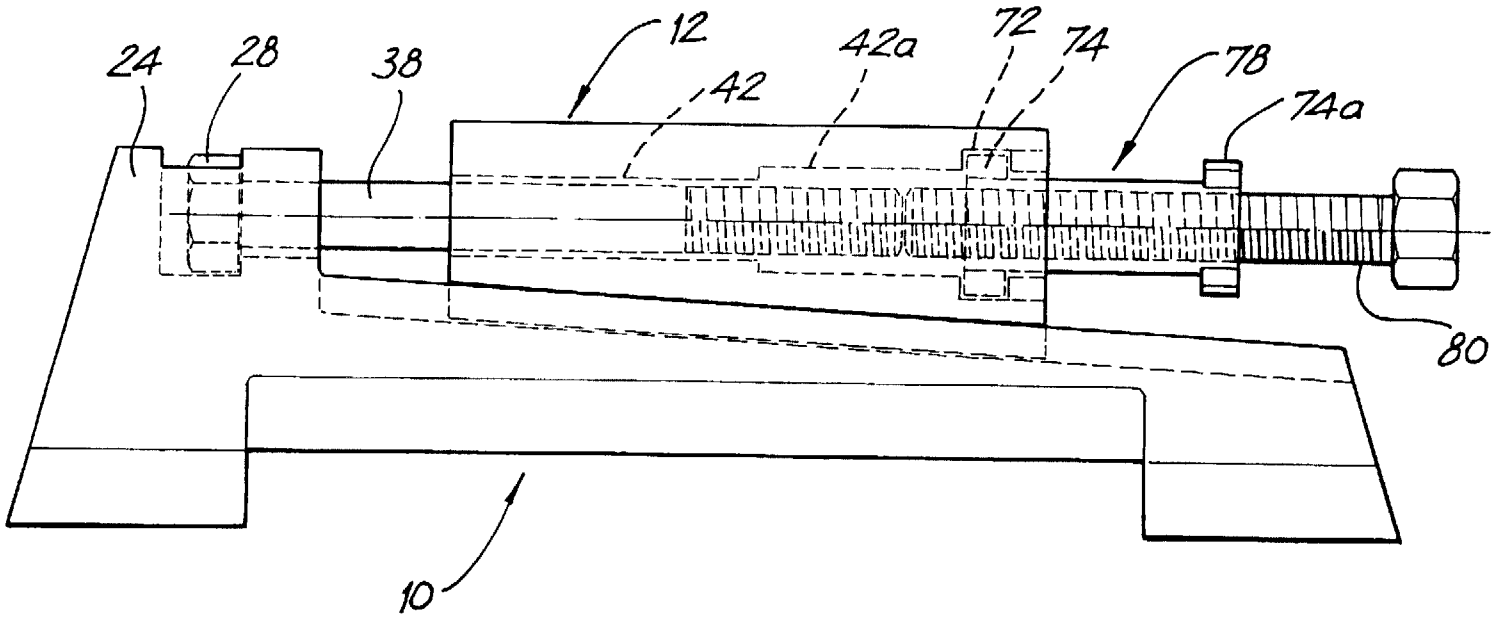
FIG. 7 is a side elevation showing a modified disengagement device.
Figure 8:
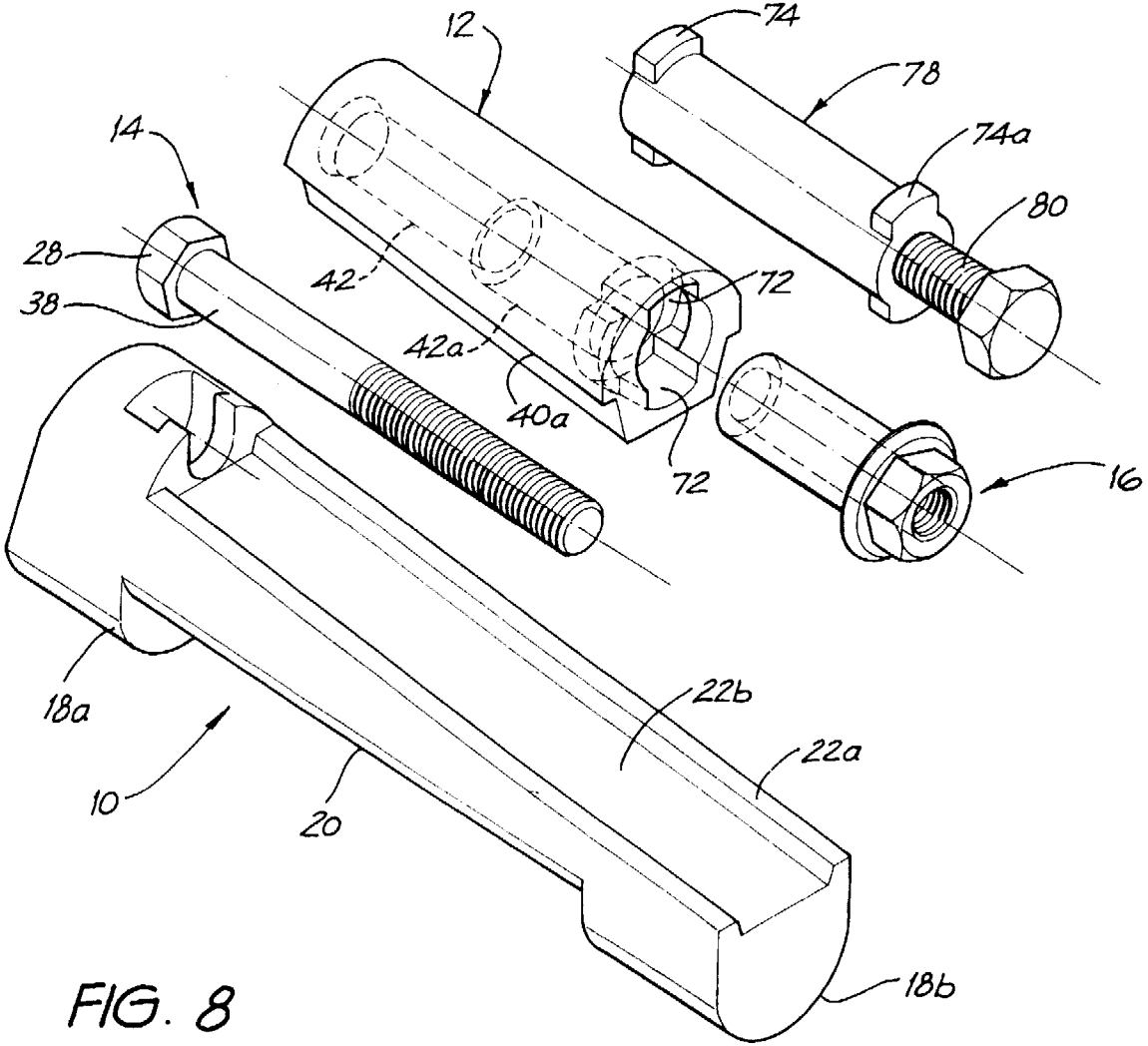
FIG. 8 is an exploded view of the arrangement of FIG. 7, showing also the modified nut for use with that embodiment.

In the modification shown in FIG. 7 and 8, the bolt shaft 38 is shortened to end inside the wedge and the nut 16 (shown in FIG. 8) and the enlarged diameter portion 42*a* of the passage 42 through the wedge are lengthened correspondingly.

At the distal end of the wedge, the entrance of the hole 42 has L-shape keyways 72 along the inner surface of the passage to receive lugs 74 on an internally threaded member 76 of a removal device 78 which further comprises a bolt 80. In use, lugs 74 of the removal device are pushed into keyways 72 and twisted to form a bayonet connection, and bolt 80 is then screwed in to bear against the end of bolt shaft 38 within the wedge. Further tightening of bolt 80 drives disengagement of the spool and wedge. The removal device 78 may include an extra set of lugs 74*a* for use if set 74 become damaged.

While particular embodiments of this invention have been described, it sill be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning find range of equivalency of the claims are therefore intended to be embraced therein.

We claim:

1. A spool and wedge assembly for attaching a replaceable implement to an earthworking bucket, the spool and wedge assembly including:

at least one spool having a first surface, at least one wedge having a second surface, the first and second surfaces co-operating to form a ramp arrangement which causes lateral expansion of the spool and wedge assembly upon relative axial movement in a first direction in which said surfaces are drawn towards each other, bolting means for forcing said relative movement in said first direction, and disengagement means separately activatable from said bolting means for causing relative movement of said spool and said wedge in a second direction opposite said first direction.

2. A spool and wed e assembly according to claim 1 wherein the disengagement means acts between the wedge and the bolting means.

3. A spool and wedge assembly according to claim 2 wherein the disengagement means applies opposite axial forces to the wedge and the bolting means respectively.

4. A spool and wedge assembly according to claim 3 wherein said axial force applied to the bolting means is transferred to the spool by the bolting means.

5. A spool and wed e assembly according to claim 3 wherein the disengagement means has means for connection to the wedge and means for applying an axial force to an end of a bolt of said bolting means.

6. A spool and wed ye assembly according to claim 5 wherein the disengagement means includes a screw member which bears against the end of the bolt.

7. A spool and wedge assembly according to claim 6 wherein the screw member screws into engagement with the wedge.

8. A spool and wedge assembly according to claim 6 wherein the disengagement means further includes a member with means for engaging the wedge so as to transfer axial force to the wedge and a screw thread with which the screw member mates.

9. A spool and wedge assembly according to claim 8 wherein said means for engaging the wedge comprises a bayonet connection to the wedge.

10. A spool and wedge assembly according to claim 9 wherein said disengagement means comprises a bayonet member releasably engageable with a keyed recess in the wedge, said bayonet member having an internal screw thread for engagement of the screw member such that the screw member aligns with an axial passage in the wedge to contact the bolt.

11. A spool and wedge assembly according to claim 1 wherein the assembly includes a single spool and a single wedge connected by said bolting means.

12. A spool and wedge assembly according to claim 11 wherein the bolting means includes a bolt captured by a formation on the spool and extends axially to enter an axial passage through the wedge.

13. A spool and wedge assembly according to claim 12 wherein the formation includes a slot which captures a head of the bolt.

14. A spool and wedge assembly according to claim 13 wherein the formation prevents rotation of the bolt head.

15. A spool and wedge assembly according to claim 1, further comprising:

resilient means which deforms under load from the bolting means so that when the bolting means is actuated to cause the lateral expansion, the resilient means applies a resilient force urging the relative movement of the spool and wedge in the first direction.

16. A spool and wedge assembly according to claim 15 wherein the resilient means comprises resilient washer means associated with the bolting means.

17. A spool and wedge assembly according to claim 16 wherein the resilient washer means acts between the bolting means and the wedge.

18. A spool and wedge assembly for attaching a replaceable implement to an earthworking bucket, the spool and wedge assembly including:

at least one spool having a first surface, at least one wedge having a second surface, the first and second surfaces co-operating to form a ramp arrangement which causes lateral expansion of the spool and wedge assembly upon relative axial movement in a first direction in which said surfaces are drawn towards each other, bolting means for forcing said relative movement in said first direction, and disengagement means axially aligned with said bolting means for applying opposite axial forces to said bolting means and at least one of said spool and said wedge to cause relative movement of said spool and said wedge in a second direction opposite said first direction.

* * * * *